US005543771A

United States Patent [19]

Levin

[11] Patent Number: 5,543,771

[45] Date of Patent: Aug. 6, 1996

[54] PHASE SHIFTING TRANSFORMER OR AUTOTRANSFORMER

[76] Inventor: Michael I. Levin, 33 Bayhampton Court, North York, Ontario, Canada, M3H 5L5

[21] Appl. No.: 398,502

[22] Filed: Mar. 3, 1995

[51] Int. Cl.[6] ..... H01F 33/00

[52] U.S. Cl. ..... 336/10; 336/1.2; 172/238

[58] Field of Search ..... 336/12, 10; 172/238

[56] References Cited

U.S. PATENT DOCUMENTS

| | | | |
|---|---|---|---|
| 1,935,419 | 11/1933 | Palley | 172/238 |
| 2,212,543 | 8/1940 | Jovy | 171/242 |
| 4,611,190 | 9/1986 | Montague | 336/10 |
| 5,003,277 | 3/1991 | Sokai et al. | 336/10 |
| 5,416,458 | 5/1995 | Menke et al. | 336/12 |

*Primary Examiner*—Leo P. Picard
*Assistant Examiner*—G. R. Lord
*Attorney, Agent, or Firm*—Mark B. Eisen

[57] ABSTRACT

A phase shifting polygonal transformer or autotransformer for a three phase electrical distribution system is provided, in which the transformer output winding or autotransformer winding is composed solely of three main coils and three auxiliary coils, alternately interconnected in series. The outputs for the transformer/autotransformer are connected to taps in the coils offset from the connections between coils, which eliminates the need for multiple auxiliary coils in each phase. The transformer/autotransformer of the invention is thus much simpler and less expensive to manufacture than a conventional phase shifting transformer or autotransformer, but reduces harmonics just as effectively.

20 Claims, 7 Drawing Sheets

PHASE SHIFTING TRANSFORMER OR AUTOTRANSFORMER

FIELD OF INVENTION

This invention relates to electrical transformers. In particular, this invention relates to three phase, phase shifting polygonal transformers or autotransformers for supplying power to multiple loads, in which the transformer outputs have the same voltage levels but are phase shifted relative to each other at selected phase angles.

BACKGROUND OF THE INVENTION

Phase shifting polygonal transformers and autotransformers are commonly used in three phase electrical networks supplying multiple non-linear loads. Non-linear loads, such as electronic equipment and equipment using various kinds of arc processes, produce undesirable harmonic currents within the network. Such harmonic-producing loads are becoming an increasingly large portion of the electrical load in many electrical networks, and can result in an unexpectedly high harmonic content in the electrical distribution system. This can lead to a number of problems which are well known to those skilled in the art.

Several techniques have been developed for reducing levels of different types of harmonics, including:

1. Different kinds of L-C filters tuned to different harmonic frequencies;
2. Specialized filters such as zero phase sequence filters of various types for three phase, four wire systems with single phase loads; and
3. Different kinds of phase shifters that allow for the creation of a quasi-multipulse system, and thus reduce harmonic levels for selected harmonics.

All of these techniques are well known and have been in widespread use for many years.

For three phase, three wire systems, polygonal phase shifting transformers and autotransformers are frequently used to reduce harmonics. However, in any case where more than two loads must be phase shifted, the use of conventional polygonal phase shifters has been problematic. It is difficult to keep the voltage levels of the various outputs within acceptable limits while obtaining the desired phase shift between outputs. This requirement considerably complicates the configuration of a conventional polygonal phase shifting transformer, as for example in the transformer described in U.S. Pat. No. 5,063,487 issued Nov. 5, 1991 for a Main and Auxiliary Transformer Rectifier System for Minimizing Line Harmonics.

SUMMARY OF THE INVENTION

This invention provides a family of economical, passive electromagnetic phase shifting transformers and autotransformers which allow for the construction of quasi-multiphase systems that reduce harmonic distortion created by non-linear loads in three phase systems, while involving substantially less cost and complexity than conventional polygonal transformers.

The transformers/autotransformers of the invention utilize specially configured windings in which the output connections are tapped into each coil at a position offset from the coil connections, to obtain the desired phase shift between outputs and yet maintain a consistent voltage level for all outputs.

The invention thus provides a phase shifting transformer output winding or autotransformer winding for a three phase electrical distribution system, comprising three auxiliary coils each alternately connected in series to three main coils at coil connections, and a plurality of outputs for each of the three phases, wherein all outputs are connected to the main and auxiliary coils at positions offset from the coil connections.

The invention further provides a phase shifting autotransformer for a three phase electrical distribution system comprising a core having three legs, a winding disposed on the core comprising three main coils alternately connected in series to three auxiliary coils at coil connections, an input connection for each phase, and a plurality of outputs for each phase, whereby the outputs comprise taps in the main coils or the auxiliary coils or both at positions offset from the coil connections.

The invention further provides a phase shifting transformer for a three phase electrical distribution system comprising a core having three legs, an input winding disposed on the core, an output winding disposed on the core comprising three main coils alternately connected in series to three auxiliary coils at coil connections, and a plurality of outputs for each phase, whereby the outputs comprise taps in the main coils or the auxiliary coils or both at positions offset from the coil connections.

BRIEF DESCRIPTION OF THE DRAWINGS

In drawings which illustrate by way of example only a preferred embodiment of the invention.

DETAILED DESCRIPTION OF THE INVENTION

Figure 1:
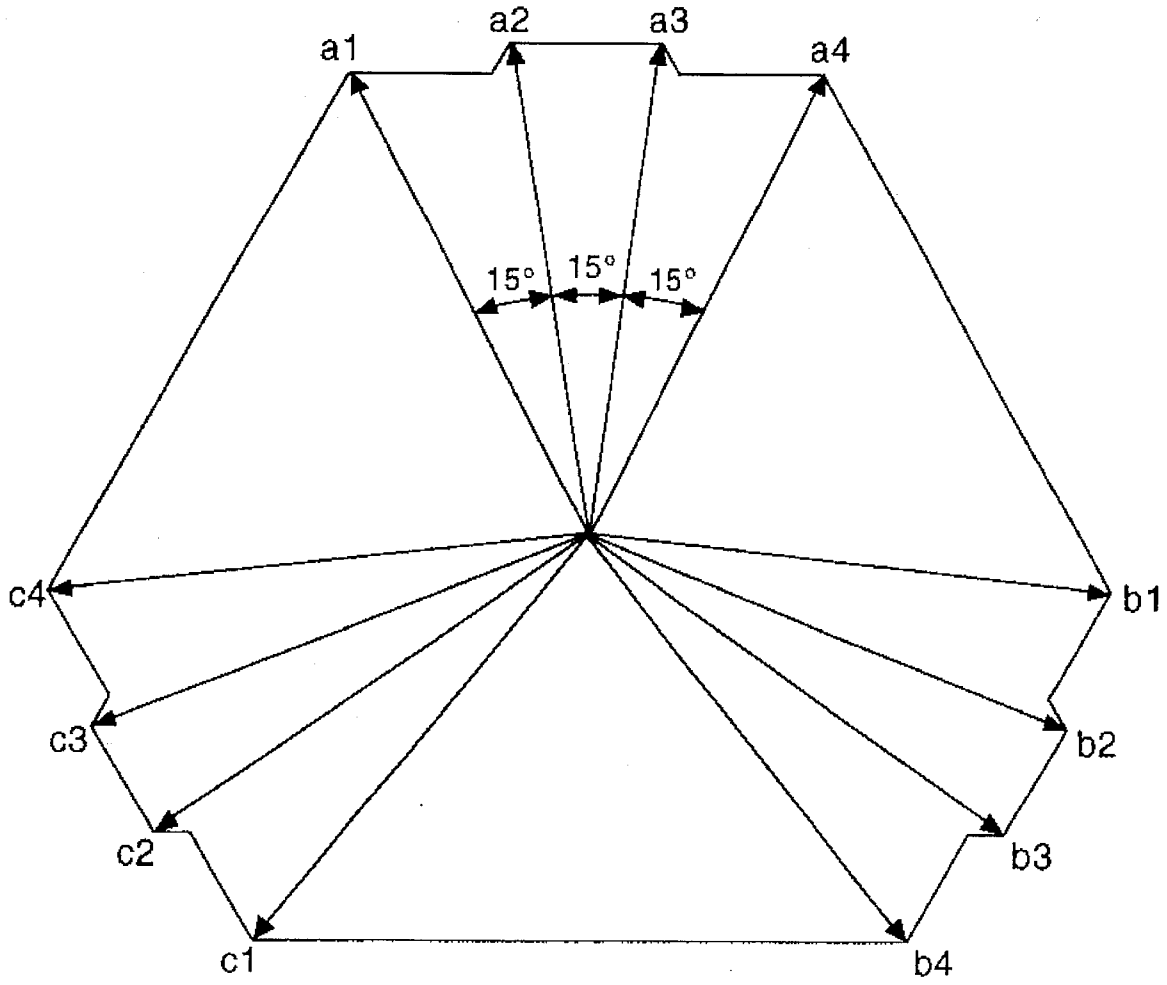
Fig. 1 Prior Art
FIG. 1 is a phasor diagram showing an output winding of a conventional hexagonal phase shifting transformer or autotransformer having four outputs phase shifted 15°.

FIG. 1 illustrates an output winding of a conventional hexagonal phase shifting transformer for a three phase, three wire system having four outputs phase shifted 15°. The winding consists of a total of 15 coils interconnected so that the outputs are formed at the coil connections. In addition to the three main coils, total of 15 auxiliary coils are required, five for each phase, to maintain a consistent voltage level as between the two middle outputs and the two outside outputs of each phase. This allows for the desired phase shift between outputs, while maintaining consistent voltage levels for all four outputs.

This is a complex configuration which requires at least eighteen separate coils for the hexagonal transformer shown, and eighteen separate connections to be made between coils on different core legs, which is both costly and highly labour intensive.

Figure 2:
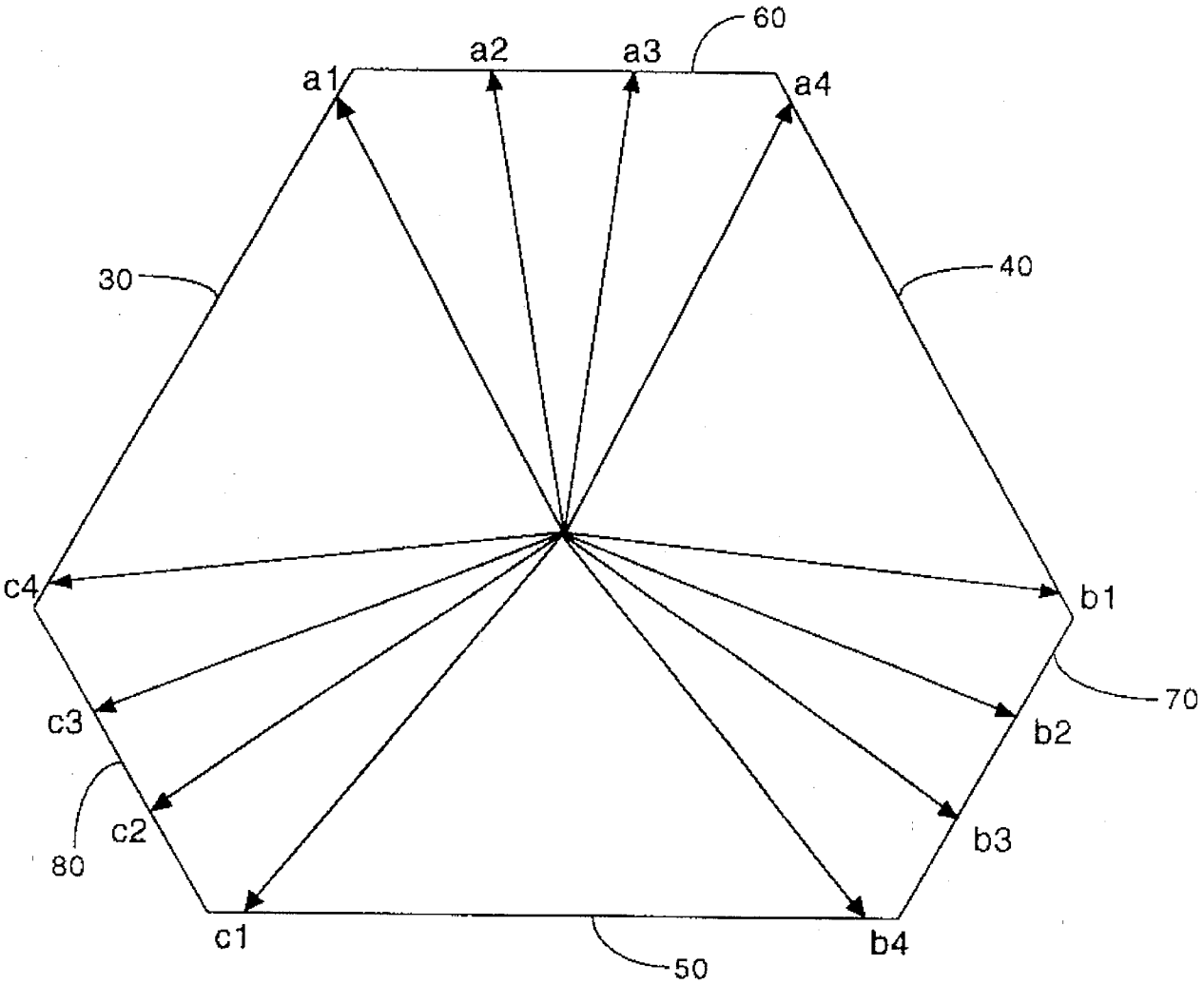
FIG. 2 is a phasor diagram showing a hexagonal phase shifting autotransformer of the invention for a three phase, three wire system, having four outputs phase shifted 15°.
Figure 3:
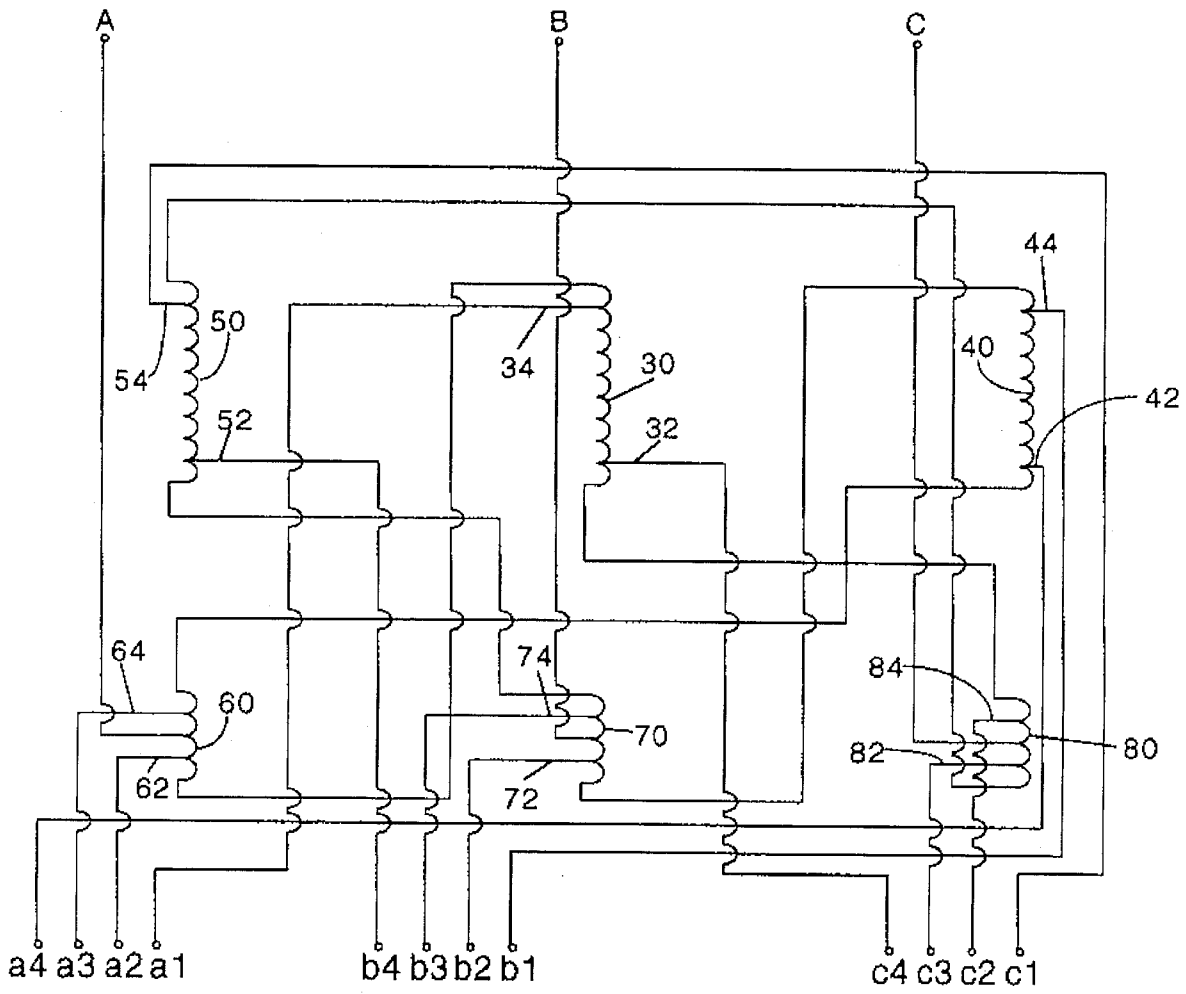
FIG. 3 is a schematic diagram of the autotransformer of FIG. 2.

A four output hexagonal phase shifting autotransformer of the invention is illustrated in FIGS. 2 and 3 in which adjacent outputs are phase shifted 15°, as in the conventional transformer output winding of FIG. 1. In the autotransformer illustrated in FIGS. 2 and 3 the main coils 30, 40, 50 are alternately interconnected to the auxiliary coils 60, 70, 80 in series, as in a conventional polygonal transformer, and the main and auxiliary coils 30, 40, 50 and 60, 70, 80 are conventionally disposed about the three legs of the core (not shown). However, each auxiliary coil 60, 70, 80 is wound with a greater number of turns than required to achieve the required phase shift between the middle outputs a2-c2 and a3-c3, which is 15° in the embodiment illustrated, and each main coil 30, 40, 50 is similarly wound with a greater number of turns, providing a simple hexagonal configuration. The correct voltage level and phase angle for each output a1–a4, b1–b4 and c1–c4 is produced by providing the main and auxiliary coils 30, 40, 50 and 60, 70, 80 with taps at suitable positions along each coil.

In effect, the coil lengths "over-extend" the output positions. In the transformer of the invention, all outputs a1–a4, b1–b4 and c1–c4 are tapped into the main coils 30, 40, 50 and auxiliary coils 60, 70, 80 at the desired phase angle. No output connections are made at the connections between the auxiliary and main coils; the output connections are all offset from the respective coil connections between the main and auxiliary coils 30, 40, 50 and 60, 70, 80.

Thus, the two outside outputs a1, a4 are connected to taps 34, 42 in the main coils 30, 40, respectively; outputs b1, b4 are respectively connected to taps 44, 52 in main coils 40, 50; and outputs cl, c4 are respectively connected to taps 54, 32 in main coils 50, 30. The two middle outputs are tapped into the auxiliary coils, so that outputs a2, a3 are connected to taps 62, 64, respectively; outputs b2, b3 are connected to taps 72, 74, respectively; and outputs c2, c3 are respectively connected to taps 82, 84.

According to this arrangement, a phase shift of 15° between adjacent outputs of each phase is achieved in the transformer or autotransformer of the invention, while the output voltage level remains consistent for all four outputs, without the need for additional auxiliary coils. The line-to-line voltage and phase shift angle are determined by the location of the tap for each specific output. Thus, the effect of this arrangement is to produce in a simple hexagonal winding a plurality of phase shifted outputs, each offset from the connections between the main and auxiliary coils and each having the same voltage level and, within any particular phase, the same phase shift angle.

Although the phase shifting transformer/autotransformer of the invention reduces harmonics several times over ordinary transformers and autotransformers, the manufacture of a transformer or autotransformer of the invention is considerably simpler and less expensive than conventional designs, and far less labour intensive. The six coil connections between the main and auxiliary coils 30, 40, 50 and 60, 70, 80 are the only connections required in the transformer/autotransformer of the invention. The various parts of the distribution system are connected directly to the taps in the main and auxiliary coils. The trigonometric calculations for determining the size of each winding and the locations of the taps for the various outputs are well known to those skilled in the art.

Figure 4:
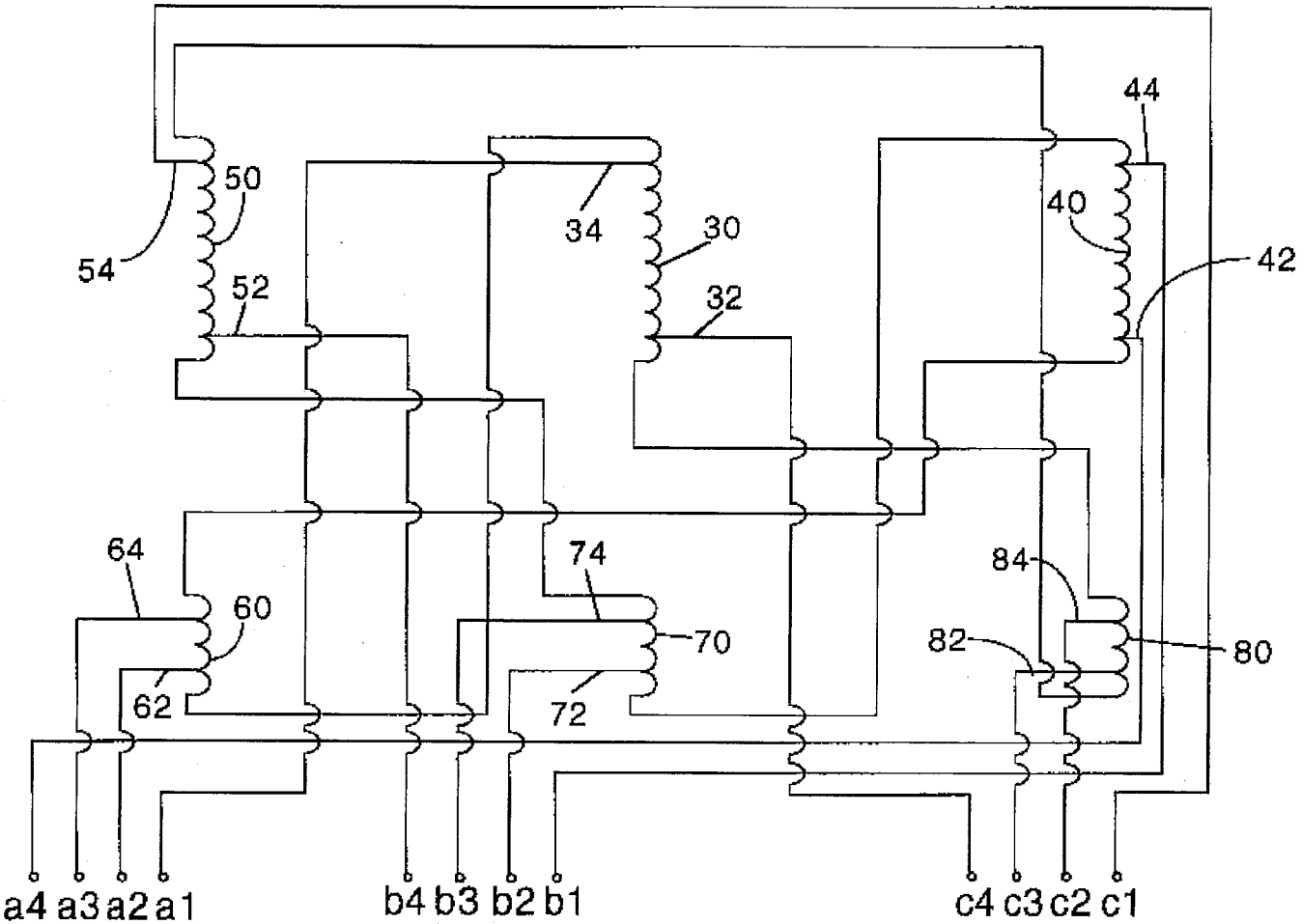
FIG. 4 is a schematic diagram of a transformer output winding embodying the invention for a three phase, three wire system, having four outputs phase shifted 15°.

It will be apparent that the invention is equally applicable to both transformers and autotransformers. For example, FIG. 4 illustrates a transformer output winding for the same three phase, three wire system as the autotransformer of FIGS. 2 and 3, but is distinguishable by the absence of the inputs A, B and C (the primary winding for the transformer of FIG. 4 is of conventional design and is not shown).

Figure 5:
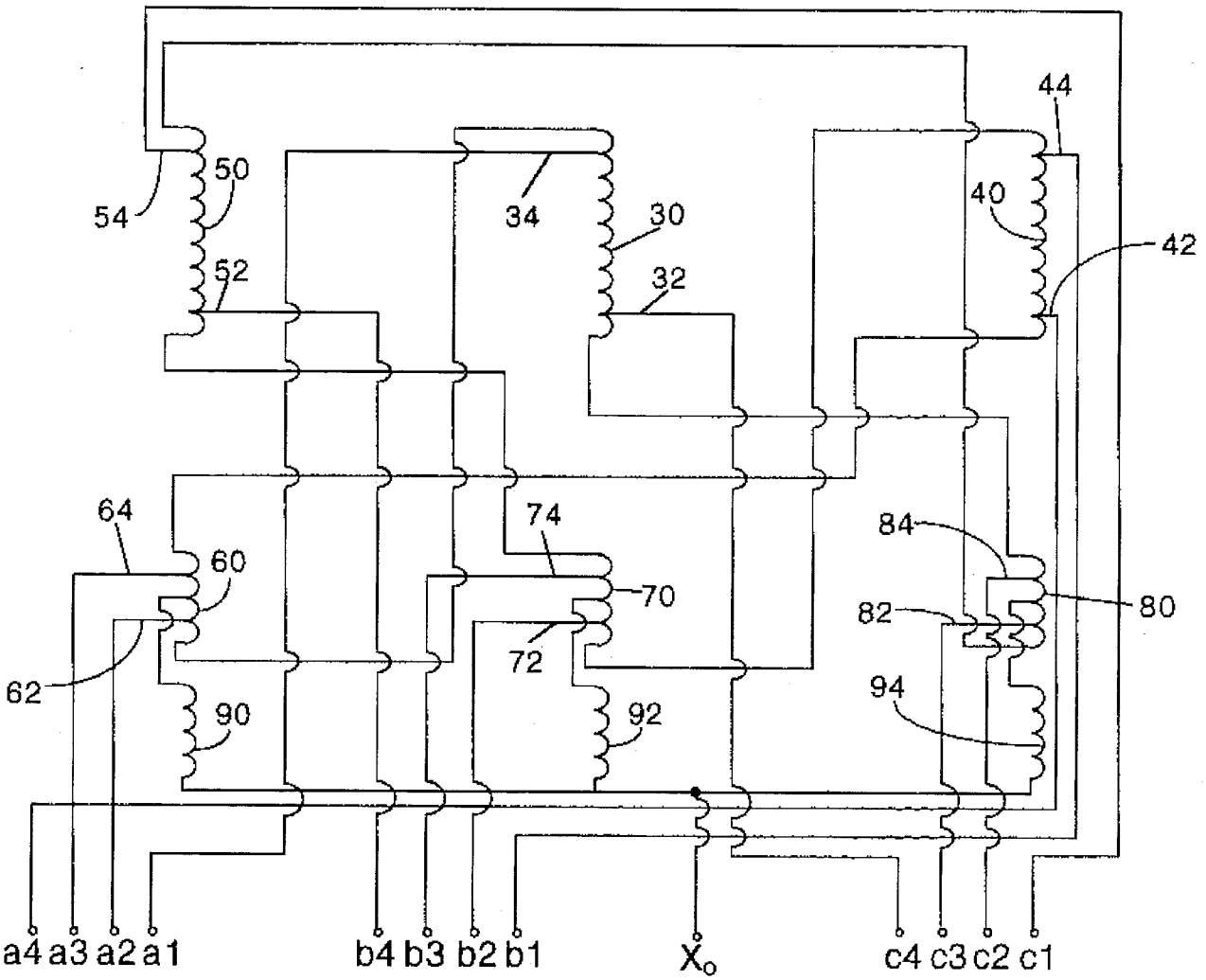
FIG. 5 is a schematic diagram of a transformer output winding for a three phase, four wire system, having four outputs phase shifted 15°.
Figure 6:
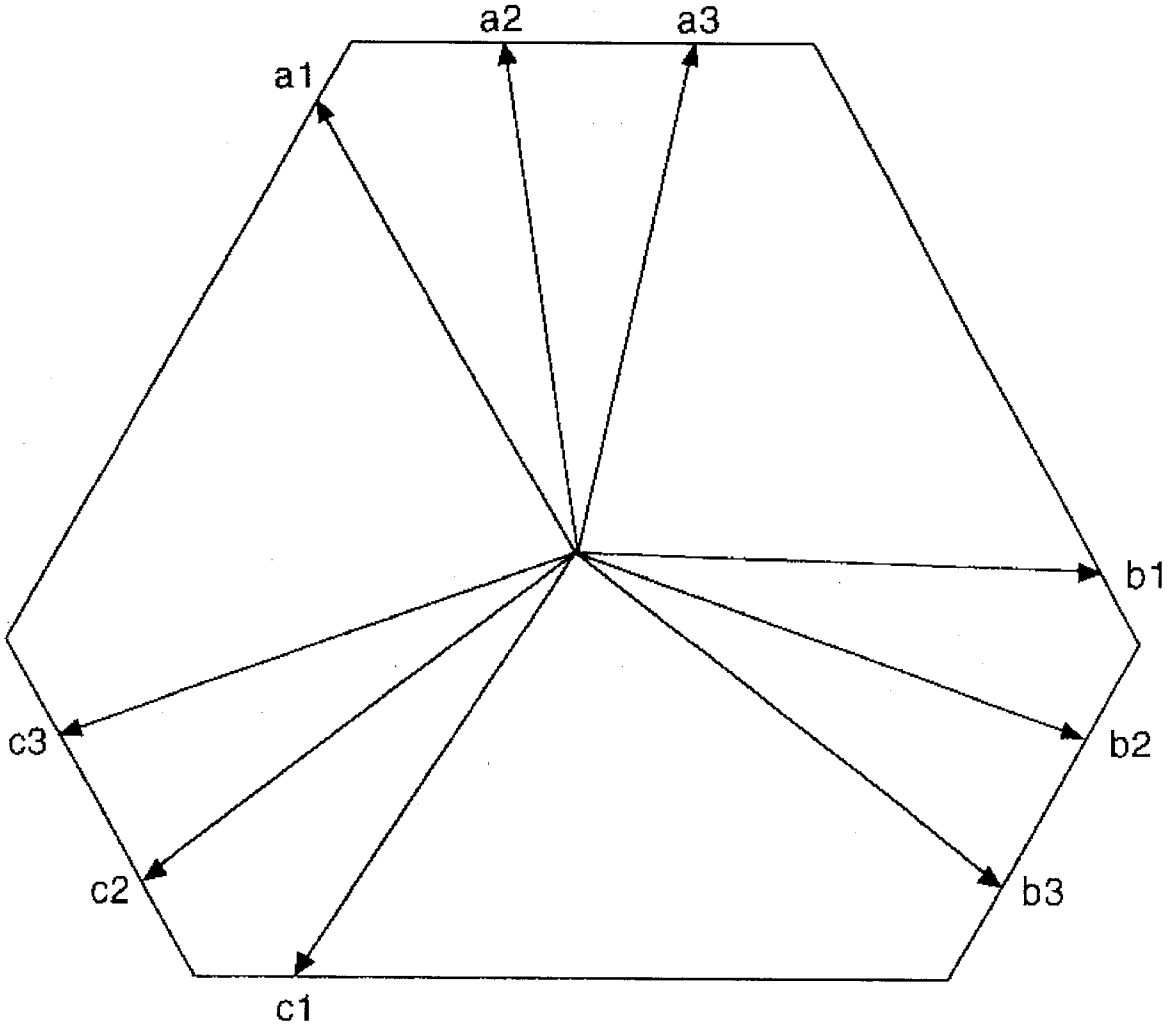
FIG. 6 is a phasor diagram showing a hexagonal phase shifting autotransformer of the invention having three outputs phase shifted 20°.

The transformer/autotransformer of the invention is effective for any distribution system supplying up to five loads, whether or not a neutral conductor is present. If a neutral point is required, the simple addition of a conventional "Y" winding, of full or reduced capacity, will suffice to achieve this. For example, FIG. 5 illustrates a transformer according to the invention similar to that illustrated in FIGS. 2 and 3 but having a neutral conductor $X_o$. The three coils 90, 92, 94 of the neutral winding are tapped into the auxiliary coils 60, 70, 80.

Figure 7:
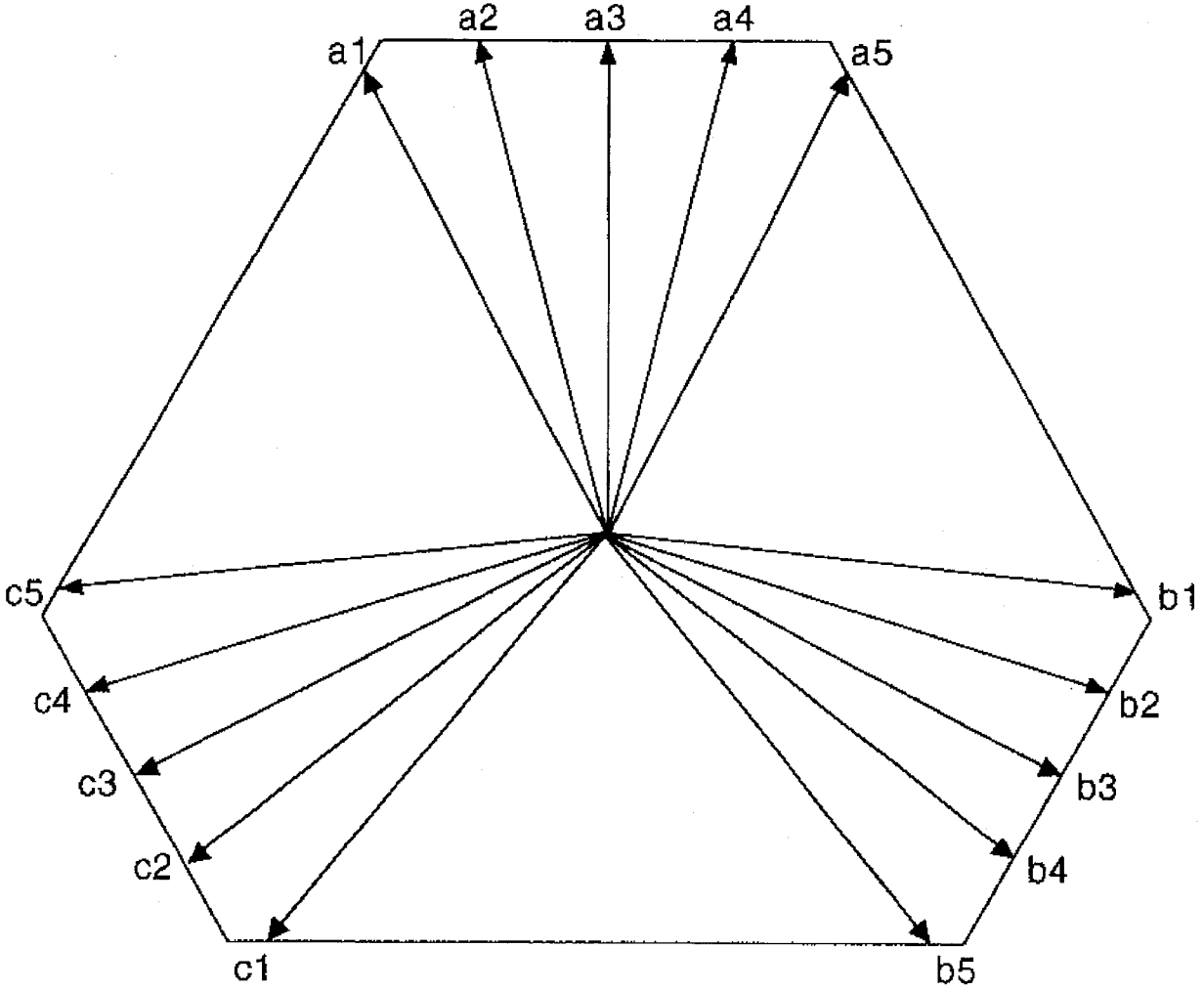
FIG. 7 is a phasor diagram showing a hexagonal phase shifting autotransformer of the invention having five outputs phase shifted 12°.

A three output embodiment of the invention is illustrated in FIG. 7. In this embodiment the phase shift between adjacent outputs is 20°, to reduce conventional harmonics of the 5th, 7th, 11th, 13th etc. orders. The design and operation of this transformer/autotransformer is exactly the same as the four output embodiment described above, except that the first output (a1-c1 in FIG. 2) has been omitted.

It should be noted that in the four and three output embodiments of FIGS. 2–6 the main and auxiliary coils 30, 40, 50 and 60, 70, 80 should be designed so that the nominal output voltage is slightly larger than the desired output voltage, to compensate for the voltage drop in the output winding conductors (usually about 2% of the input voltage).

A five output embodiment of the invention is illustrated in FIG. 7. In this embodiment the outputs are phase shifted 12°, to reduce harmonics of the 5th, 7th, 11th, 13th, 17th, 19th, 23rd, 25th etc. orders. The voltage level of the centre output a3, b3, c3 is slightly lower than that of the other outputs, but since the centre output a3, b3, c3 is connected directly to the input winding it experiences no voltage drop. Thus, the actual output voltage level at for example outputs a3 will be comparable to the output voltage level of the other four outputs a1, a2, a4 and a5.

As noted above, the invention will operate effectively with up to five outputs, phase shifted as closely as 12°. As is known, it is possible to reduce higher harmonic orders in a distribution system involving multiple transformers or autotransformers by connecting the input conductors at different positions in the different transformers. The phase shift between different transformers can be as small as required to suppress the higher harmonics.

The invention having been described with reference to a preferred embodiment, it will be apparent to those skilled in the art that modifications and adaptations may be made to the invention without departing from the scope of the invention. All such variants are intended to fall within the scope of the invention as delimited by the appended claims.

I claim:

1. A phase shifting transformer output winding or autotransformer winding for a three phase electrical distribution system, comprising three auxiliary coils each alternately connected in series to three main coils at coil connections, and a plurality of outputs for each of the three phases, wherein all outputs are connected to the main and auxiliary coils at positions offset from the coil connections.

2. The winding of claim 1 in which two of the plurality of outputs are connected to taps in the auxiliary coils.

3. The winding of claim 2 in which each phase is provided with three or four outputs.

4. The winding of claim 3 in which at least one of the plurality of outputs for each phase is connected to taps in the main coils.

5. The winding of claim 4 in which adjacent outputs within each phase are phase shifted 12, 15 or 20 degrees.

6. The winding of claim 1 in which each phase is provided with five outputs, one output for each phase being connected to a tap in each of the auxiliary coils at a position in phase with inputs to the transformer or autotransformer.

7. The winding of claim 1 including a neutral point.

8. A phase shifting autotransformer for a three phase electrical distribution system comprising a core having three legs, a winding disposed on the core comprising three main coils alternately connected in series to three auxiliary coils at coil connections, an input connection for each phase, and a plurality of outputs for each phase, whereby the outputs comprise taps in the main coils or the auxiliary coils or both at positions offset from the coil connections.

9. The phase shifting autotransformer of claim 8 in which two of the plurality of outputs are connected to taps in the auxiliary coils.

10. The phase shifting autotransformer of claim 9 in which each phase is provided with three or four outputs.

11. The phase shifting autotransformer of claim 10 in which at least one of the plurality of outputs for each phase is connected to taps in the main coils.

12. The phase shifting autotransformer of claim 11 in which adjacent outputs within each phase are phase shifted 12, 15 or 20 degrees.

13. The phase shifting autotransformer of claim 8 including a neutral point.

14. The phase shifting autotransformer of claim 8 in which each phase is provided with five outputs, one output for each phase being connected to a tap in each of the auxiliary coils at the input connections.

15. A phase shifting transformer for a three phase electrical distribution system comprising a core having three legs, an input winding disposed on the core, an output winding disposed on the core comprising three main coils alternately connected in series to three auxiliary coils at coil connections, and a plurality of outputs for each phase, whereby the outputs comprise taps in the main coils or the auxiliary coils or both at positions offset from the coil connections.

16. The phase shifting transformer of claim 15 in which two of the plurality of outputs are connected to taps in the auxiliary coils.

17. The phase shifting transformer of claim 16 in which each phase is provided with three or four outputs.

18. The phase shifting transformer of claim 17 in which at least one of the plurality of outputs for each phase is connected to taps in the main coils.

19. The phase shifting transformer of claim 18 in which adjacent outputs within each phase are phase shifted 12, 15 or 20 degrees.

20. The phase shifting transformer of claim 15 including a neutral point.

* * * * *